US005492061A

United States Patent [19]

Park et al.

[11] Patent Number: 5,492,061

[45] Date of Patent: Feb. 20, 1996

[54] THERMAL PRINTING METHOD

[75] Inventors: Keun-yong Park; Jong-woo Kim, both of Suwon, Rep. of Korea

[73] Assignee: Samsung Electronics Co., Ltd., Kyungki, Rep. of Korea

[21] Appl. No.: 314,379

[22] Filed: Sep. 28, 1994

[30] Foreign Application Priority Data

Sep. 28, 1993 [KR] Rep. of Korea ..... 93-20332
Sep. 29, 1993 [KR] Rep. of Korea ..... 93-20549

[51] Int. Cl.[6] ..... B41J 1/32

[52] U.S. Cl. ..... 101/486; 400/120.01; 101/93.01; 101/93.04; 347/171

[58] Field of Search ..... 400/120.01, 120.02, 400/120.03, 120.04, 120.16, 624, 625, 708, 708.1, 629, 632; 271/258, 259; 346/76 PH; 101/93.01, 93.04, 486

[56] References Cited

U.S. PATENT DOCUMENTS 4,834,568 5/1989 Kagami et al. ..... 400/708
4,844,631 7/1989 Feron et al. ..... 400/708
5,110,227 5/1992 Hatakeyama et al. ..... 400/120.04

FOREIGN PATENT DOCUMENTS 2716396 10/1978 Germany ..... 400/632
0067184 4/1985 Japan ..... 400/629
0053859 3/1987 Japan ..... 400/632

OTHER PUBLICATIONS

"Single–Sheet Paper–Feeding Mechanism" IBM Technical Disclosure Bulletin, vol. 27, No. 3, 8184 pp. 1395–1396.
"Automatic Sheet Feeder", IBM Technical Disclosure Bulletin, vol. 28, No. 3, Aug. 1985 pp. 1061–1062.

*Primary Examiner*—Eugene H. Eickholt
*Attorney, Agent, or Firm*—Sughrue, Mion, Zinn, Macpeak & Seas

[57] ABSTRACT

A thermal printing method is performed by sublimating an ink film using the heat of a thermal print head with a printing paper being supplied to a rotating drum for transferring. Printing paper is sensed by a sensor for sensing the leading edge thereof, and an image is printed on the printing paper from its leading edge in accordance with the sensed result, so as to print on the printing paper without margins.

5 Claims, 9 Drawing Sheets

THERMAL PRINTING METHOD

BACKGROUND OF THE INVENTION

1. Field of the Invention

The present invention relates to a thermal printing method and, more particularly, to a method of printing without margins along the leading and trailing edges of a sheet of printing paper.

2. Description of the Related Art

Generally, a thermal printer has a transfer structure such that, an ink film ribbon is placed between a thermal print head and printing paper which is the object of the printing operation, so that ink sublimated by the thermal print head to a predetermined pattern is transferred onto the printing paper. In a color thermal printer, analytic images of yellow, magenta and cyan, which have been color-analyzed for full color implementation, are repeatedly printed three times, respectively.

FIG. 1 is a plan view of a sheet of printing paper printed by a conventional printing method. As shown in FIG. 1, an actual image 1 printed on the printing paper is printed such that a margin 2 is present along the edges of the printing paper. Such a conventional printing method will be explained with reference to FIGS. 2, 3 and 4.

First, FIG. 2 is a side view of a drum type printer for explaining the conventional printing method.

Referring to FIG. 2, a printing paper cassette 9 is provided on one side of the lower part of drum 4. A paper supplying roller 7, which is placed at the outer periphery of drum 4, supplies printing paper 3 from the printing paper cassette 9. A clamp 5 for clamping the leading edge of each sheet of the printing paper 3 and for transferring the printing paper to drum 4 is provided on the drum 4. Above drum 4, a thermal print head 10 heated by a heat generating element is provided so as to be capable of moving up and down. A ribbon of ink film 12 is provided between thermal print head 10 and the printing paper 3, so that ink is sublimated by the heat and pressure of the thermal print head to print an image on the printing paper.

In the above conventional thermal printer, first, printing paper 3 is transferred from printing paper cassette 9 to drum 4. Then, if the printing paper 3 is located between the drum 4 and the thermal print head 10, the clamp 5 clamps the leading edge of the printing paper 3. Subsequently, the clamp 5 and the drum 4 are rotated to transfer the leading edge of printing paper 3 to a position offset from the position directly under thermal print head 10. This offset position is selected because, if clamp 5 were located at the initial printing position (a position A' directly under thermal print head), the clamp 5 would interfere with the thermal print head 10 when the print head is lowered for printing.

In contrast to the drum type printer of FIG. 2, FIG. 3 shows a platen type printer according to another conventional printing method. Here, the difference is that, instead of clamp 5 which clamps the leading edge of printing paper 3 to transfer the printing paper to the drum 4, guide rollers 8 and 8' are provided for transferring printing paper 3 from printing paper cassette 9 and guiding the printing paper while in contact with the drum 4.

In the platen type printer shown in FIG. 3 which utilizes guide rollers 8 and 8' since the printing paper tends to separate from drum 4 before it arrives at the initial printing position A' of the thermal print head 10, the thermal print head 10 is not moved down for printing until printing paper 3 is transferred by guide roller 8'. Thus, it is difficult to print on the leading margin of the printing paper 3.

FIG. 4 shows a capstan roller type printer according to still another conventional printing method.

Comparing the printer shown in FIG. 4 with those shown in FIGS. 2 and 3, the printing paper 3 is transferred and guided by the rotation of capstan rollers 8" and 8''' instead of drum 4. Drum 14 of FIG. 4 supports printing paper 3 transferred by capstan rollers 8" and 8''' and, when the thermal print head 10 is moved down, also provides support for ink ribbon 12.

In the conventional capstan roller type printer shown in FIG. 4, since thermal print head 10 is not moved to start printing until the printing paper is transferred by the second capstan roller 8''' for tightening the printing paper, the space from the top point of the second capstan roller 8''' to the initial printing position A' remains as a margin on the leading edge of printing paper 3. At the same time, the space from initial printing position A' to the top point of the first capstan roller 8" remains as a margin on the trailing edge of printing paper 3.

U.S. Pat. No. 5,001,498 discloses a thermal printer which, for eliminating the margin of the printing paper generated in the capstan roller type printer shown in FIG. 4, prints from the leading edge of the printing paper to the trailing edge thereof, by transferring the printing paper until the leading edge of the printing paper arrives at a specific point of a platen roller supporting the ink film and the paper, and then performing a printing operation. In the above patent, printing paper is transferred by the pressing of the roller and prints without leading and trailing margins.

On the other hand, the left and the right margins shown in FIG. 1, can be eliminated by controlling the size of thermal print head 10 (shown in FIGS. 2–4), but the leading margin of the printing paper still remains. Therefore, for the sake of appearance, left, right and trailing edge margins should also be reserved.

This margin does not provide a good appearance and wastes printing paper. Also, when an image input through an image input apparatus such as a scanner is printed by the above printer, the image to be printed is compressed and/or truncated before being printed.

SUMMARY OF THE INVENTION

Accordingly, an object of the present invention is to provide a thermal printing method for printing an original image even on the leading and trailing edges of a sheet of printing paper.

Another object of the present invention is to provide a thermal printing method for printing on the entire sheet of printing paper, without margins, in a thermal printer which transfers the printing paper by the rotation of a drum.

To attain the above first object, there is provided a thermal printing method according to the present invention, in which, while printing paper is supplied to a rotating drum so as to be transferred, printing is performed by sublimating an ink film using heat generated by a thermal print head, comprising the steps of: sensing the leading edge of the printing paper using at least one sensor which generates a signal indicating the presence of the transferred printing paper; and controlling the thermal print head in accordance with the signal indication, such that printing begins when the leading edge of the printing paper is transferred to an initial printing position.

To attain the other object, there is provided a thermal printing method according to the present invention, in which, while printing paper is supplied to a rotating drum so as to be transferred, printing is performed by sublimating an ink film using heat generated by a thermal print head, comprising the steps of: sensing the leading edge of the transferred printing paper, by placing a first sensor, which generates a sensing signal indicating the presence of the printing paper, at a position slightly beyond an initial printing position of the thermal print head; moving the thermal print head down in accordance with the sensing signal, so as to permit the thermal print head to press against the recording paper; and reversely driving the drum in order to position the leading edge of the printing paper back to the initial printing position while the thermal print head is down, and then driving the drum in order to print from the leading edge of the printing paper to the trailing edge thereof.

BRIEF DESCRIPTION OF THE DRAWINGS

The above objects and advantages of the present invention will become more apparent by describing in detail a preferred embodiment thereof with reference to the accompanying drawings in which.

DETAILED DESCRIPTION OF THE PREFERRED EMBODIMENTS

Figure 1:
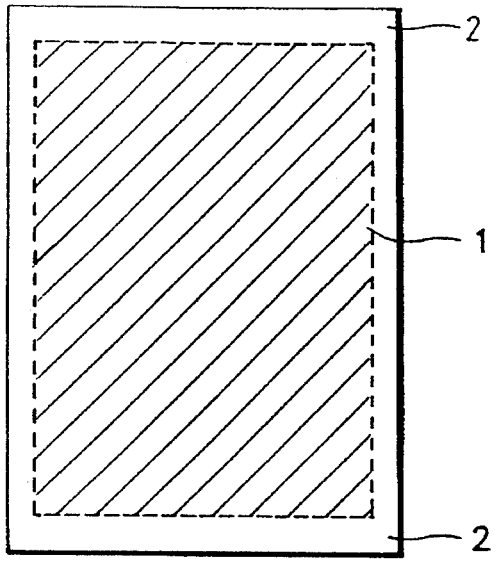
FIG. 1 is a plan view of a sheet of printing paper printed by a conventional printing method.
Figure 2:
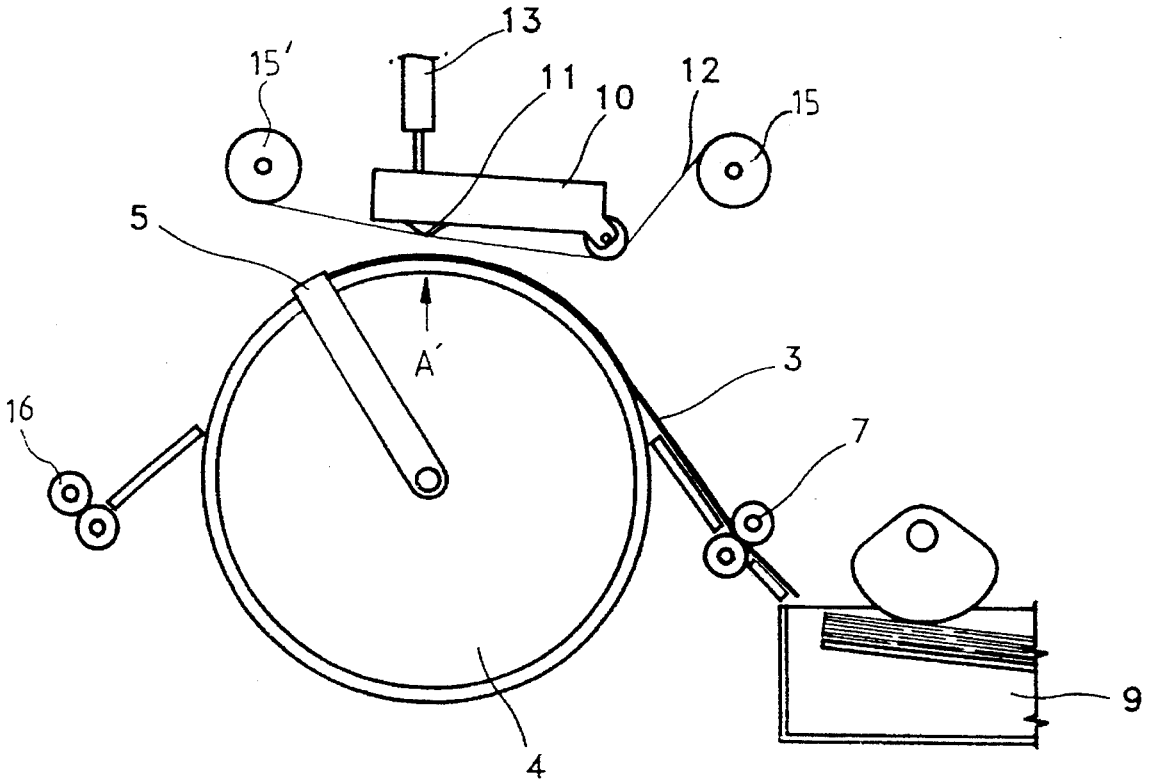
FIG. 2 is a side view of a drum type printer for explaining a conventional printing method.
Figure 3:
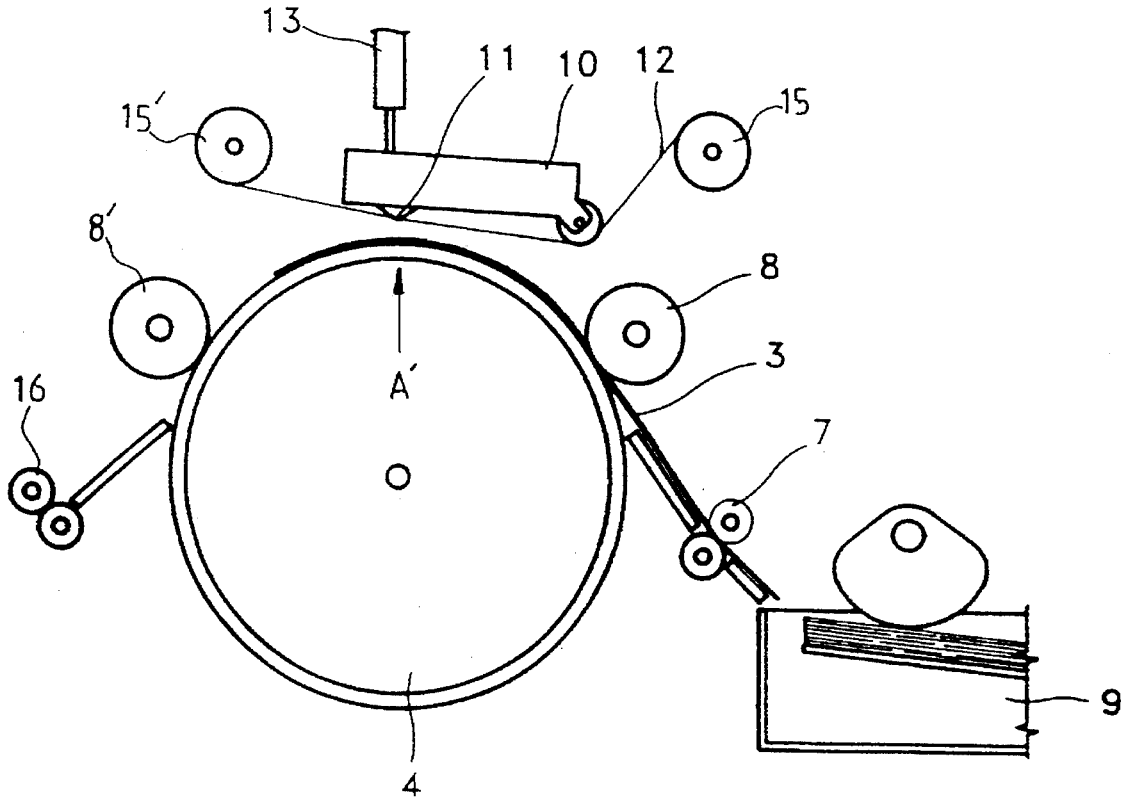
FIG. 3 is a side view of a platen drum type printer for explaining a conventional printing method.
Figure 4:
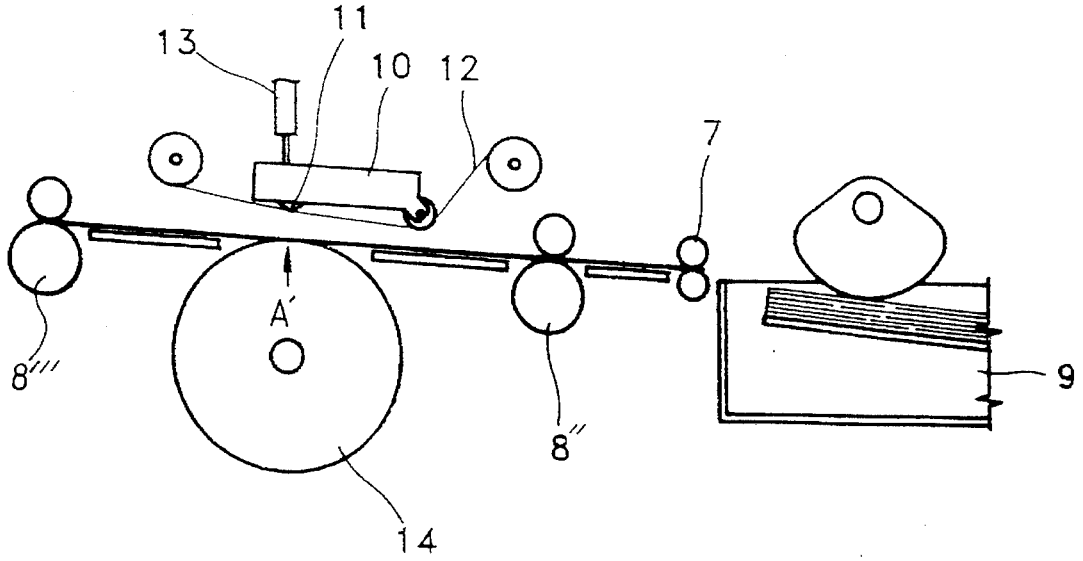
FIG. 4 is a side view of a capstan roller type printer for explaining a conventional printing method.

The printing method according to a first embodiment of the present invention will explained by referring to FIGS. 5–8.

A printer according to the first embodiment of the present invention includes a thermal print head 51, a heat generating element 52, a control element 62, an ink film 53, a supply reel 54, a take-up reel 54', a drum 60, first and second rollers 55 and 56, a paper supplying roller 57, a printing paper cassette 61, a first sensor 58, a second sensor 59, sensor supporting elements 58' and 59', and a paper ejecting roller 65.

The thermal print head 51 is supported such that up and down movement is possible while generating heat in accordance with image data. The heat generating element 52 is provided in the lower part of thermal print head 51 and is composed of a resistive material. Control element 62 is placed on the upper part of thermal print head 51, for controlling its up and down movement and pressing the print head against the drum.

The ink film 53, having yellow, magenta and cyan inks deposited therein, is located below the thermal print head 51. Supply reel 54 supplies ink film 53, and take-up reel 54' winds the supplied ink film 53.

The drum 60 is placed under ink film 53 and is rotated in accordance with a driving signal of a drive source (not shown). The first and second rollers 55 and 56 are for transferring and guiding the printing paper 63 while in contact with drum 60. The paper supplying rollers 57 are for supplying the printing paper 63 via the space between drum 60 and first roller 55. The printing paper cassette 61 supplies the printing paper 63 to paper supplying rollers 57.

The first sensor 58 is provided at the periphery of drum 60 and between the initial printing position A and the first roller 55, and the second sensor 59 is provided at the periphery of the drum 60 and between the initial printing position A and the second roller 56. The supporting elements 58' and 59' respectively support first and second sensors 58 and 59. The paper ejecting rollers 65 eject the printing paper 63.

Now, the operation of a printer which performs the above printing method according to the first embodiment will be described.

Figure 5:
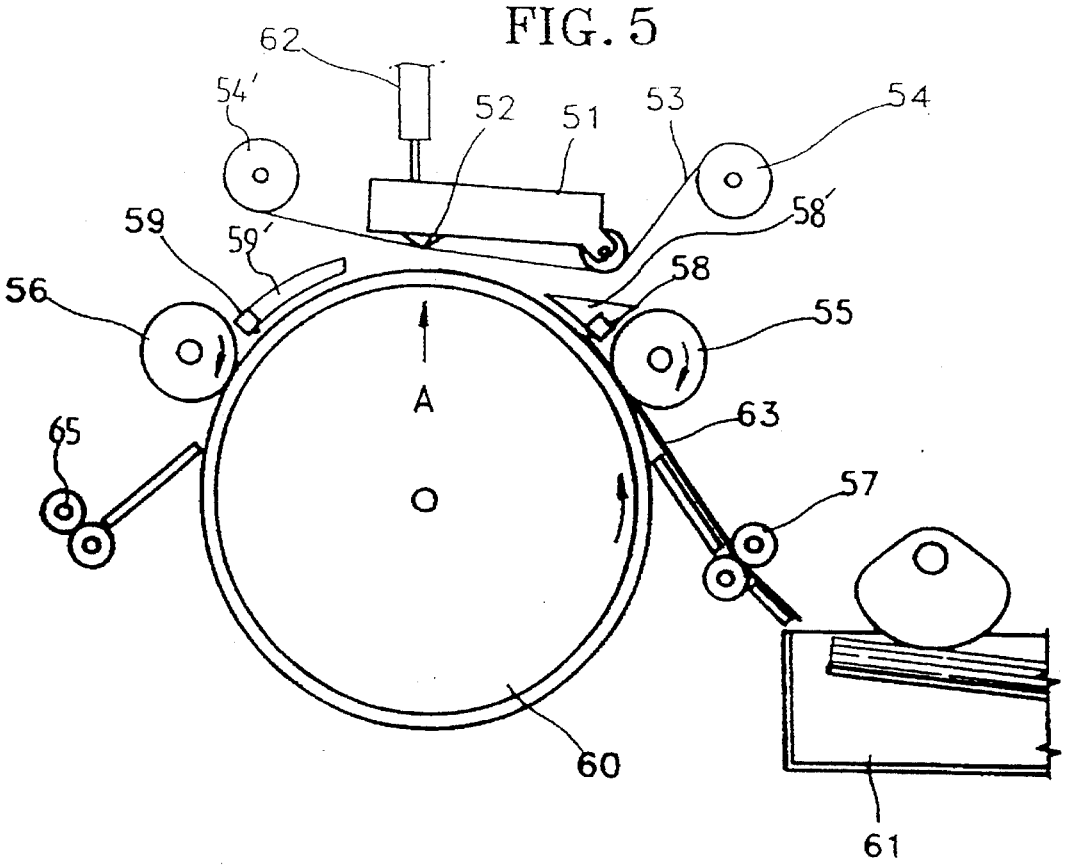
FIGS. 5–8 are operative views for illustrating a thermal printing method according to one embodiment of the present invention.
Figure 6:
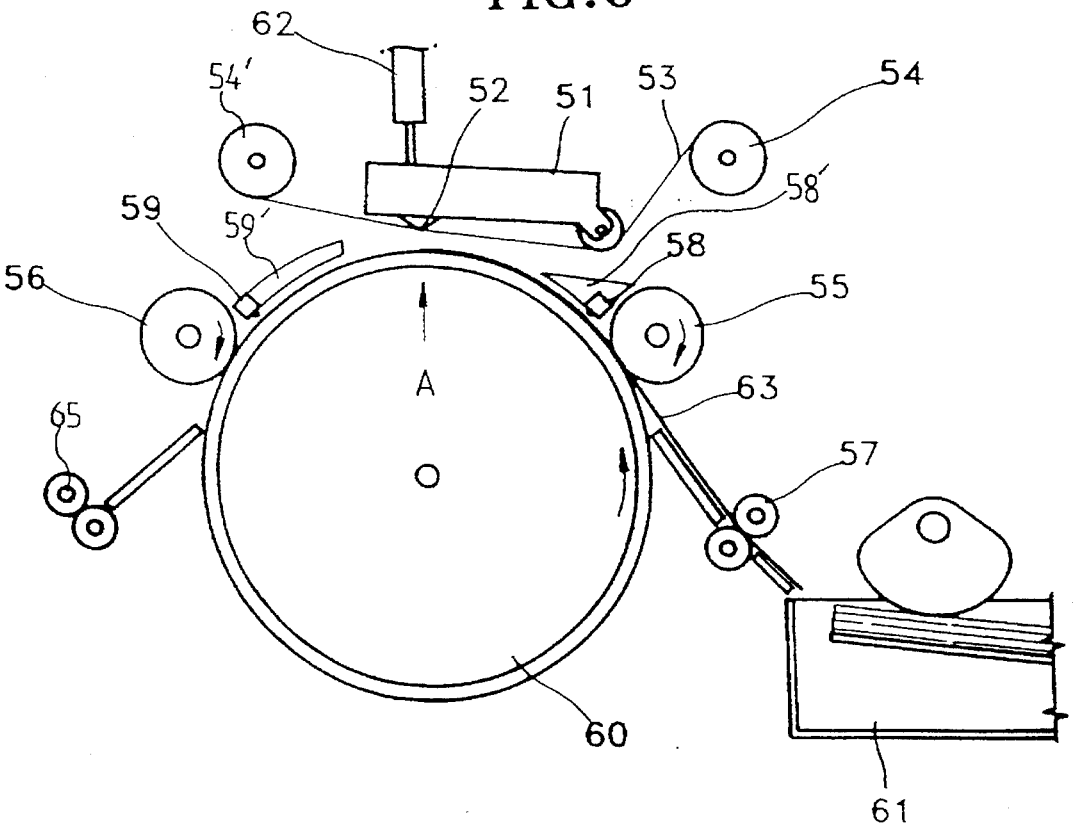
Figure 7:
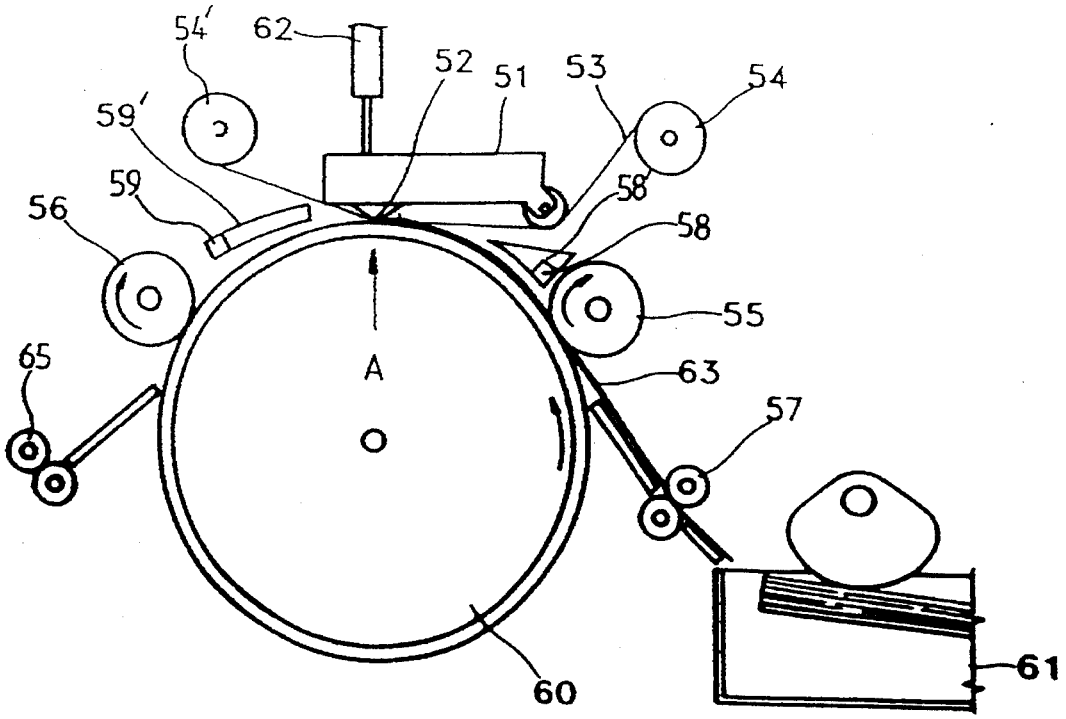

As shown in FIG. 5, the printing paper 63 supplied from the printing paper cassette 61 is guided by paper supplying rollers 57 to be transferred by the rotation force of the drum 60 and the friction force of the first roller 55 through the space between the drum 60 and the first roller 55, while in contact therewith. The printing paper 63 exiting the first roller 55 toward the initial printing position A is sensed by first sensor 58 placed above the first roller 55. The signal according to the result of sensing by first sensor 58 is fed to a drive source (not shown). The drum 60, receiving a driving signal from the drive source as shown in FIG. 6, rotates so that the leading edge of the printing paper is positioned at the initial printing position A. As shown in FIG. 7, the thermal print head 51 is moved down so as to print an image on the printing paper 63 starting from the leading edge of the printing paper 63, at the initial printing position A. When first sensor 58 for sensing the printing paper 63 senses the trailing end of the printing paper 63, the drum 60 rotates to the initial printing position A so as to print on the trailing end of the printing paper while in that position.

Figure 8:
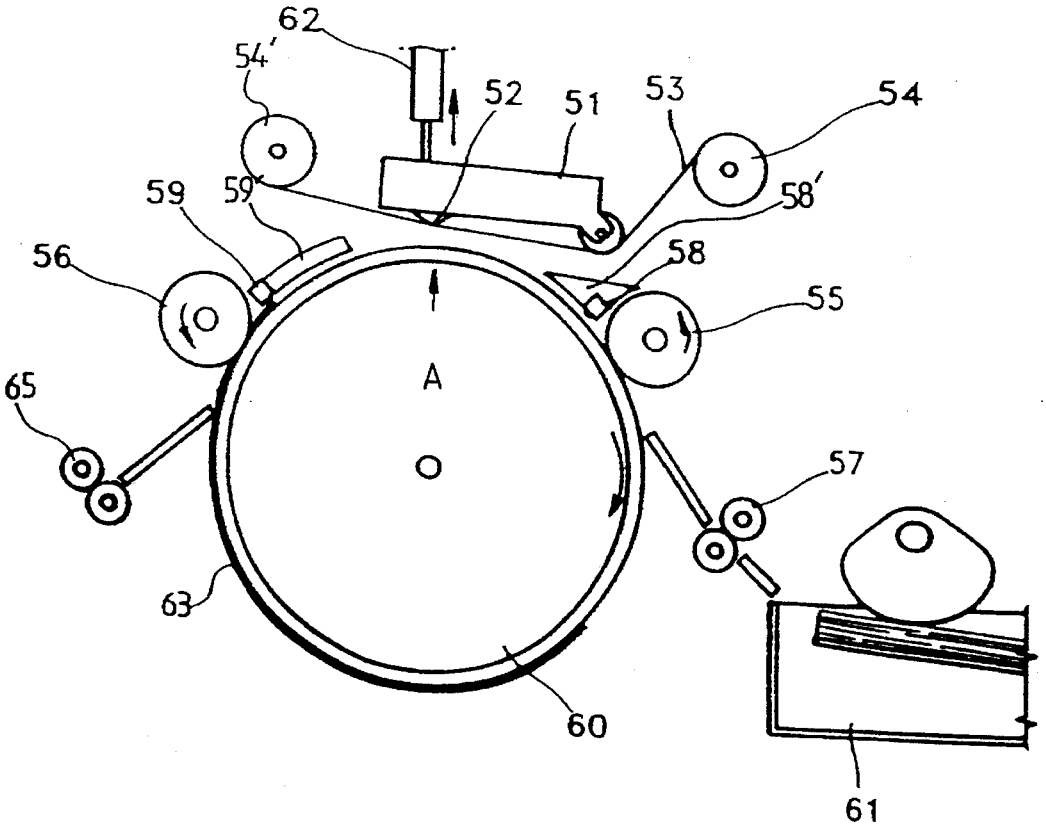

After the printing is finished, the printing paper 63 is guided by the second roller 56 to be moved to the lower part of the second sensor 59 for sensing the printing paper 63, and the transferred printing paper 63 is again transferred to the initial printing position A by the reverse rotation of the drum 60. In other words, during the transferring, the trailing end of the printing paper 63 is sensed by the second sensor 59 and, as shown in FIG. 8, the thermal print head 51 is moved up at that sensed position. Drum 60 and the rollers 55 and 56 reversely rotate so that the printing paper is reversely transferred to the initial printing position A, and an image is printed on the printing paper 63 from its trailing edge to its leading edge, by the thermal print head 51.

Repeatedly printing with regard to yellow, cyan and magenta through the method described above produces a full color image on the whole printing paper.

Next, the second embodiment of the printing method according to the present invention will be explained, referring to FIGS. 9–15.

Figure 9:
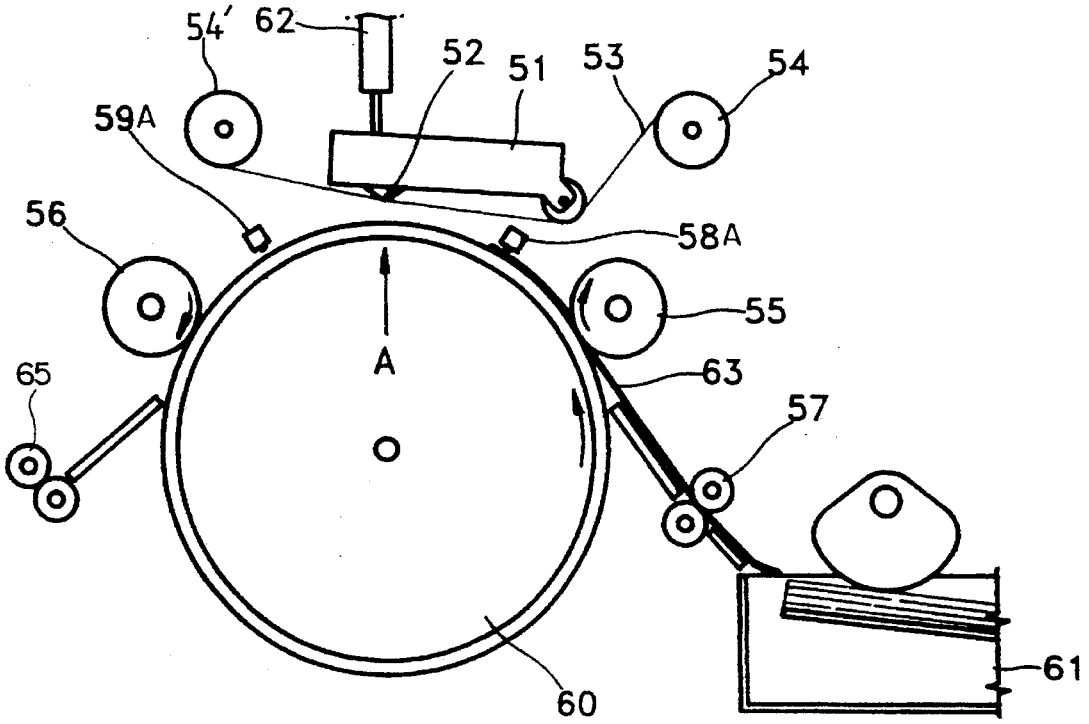
FIGS. 9–15 are operative views for illustrating a thermal printing method according to another embodiment of the present invention.

The structure of the printer which can utilize the second embodiment shown in FIG. 9 is similar to that which can utilize the first embodiment shown in FIG. 5. Like elements are designated by the same reference numerals.

Figure 10:
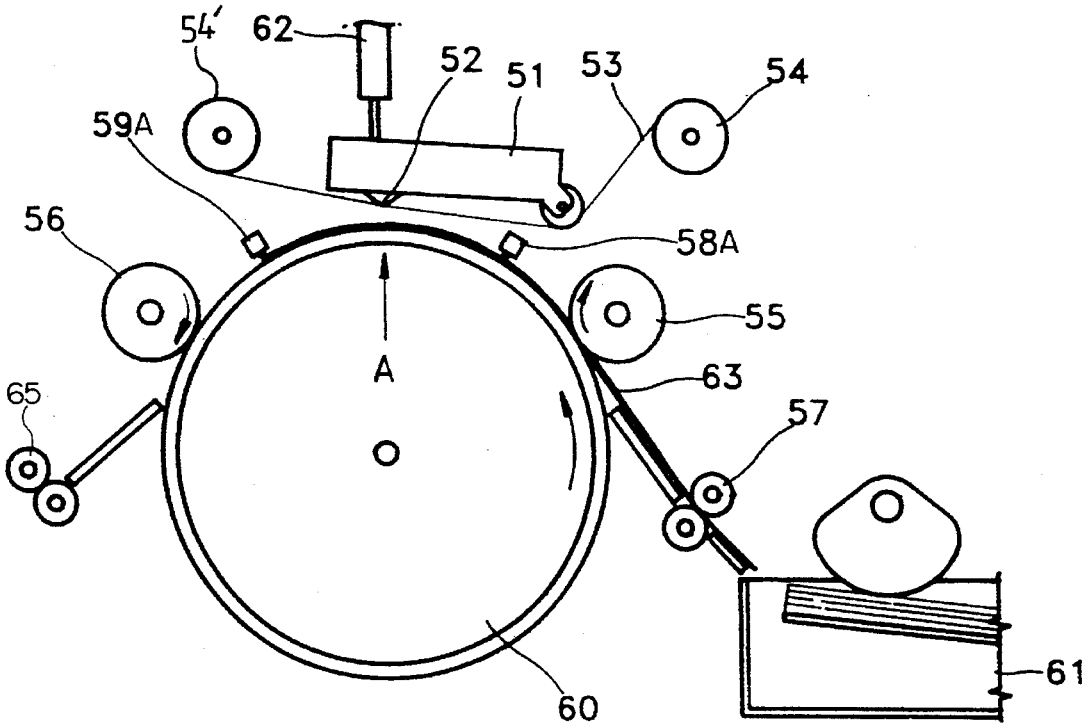

Considering the printing method according to the second embodiment, as shown in FIG. 9, the printing paper 63 which is supplied from printing paper cassette 61 is guided by paper supplying rollers 57, so that the printing paper 63 is transferred between the drum 60 and the first roller 55 by the rotation force of the drum 60 and the friction force of the first roller 55, while in contact therewith. The printing paper 63 exiting the first roller 55 toward the initial printing position A, as shown in FIG. 10, is transferred to a position slightly offset from the second sensor 59A, passing through the initial printing position A.

Figure 11:
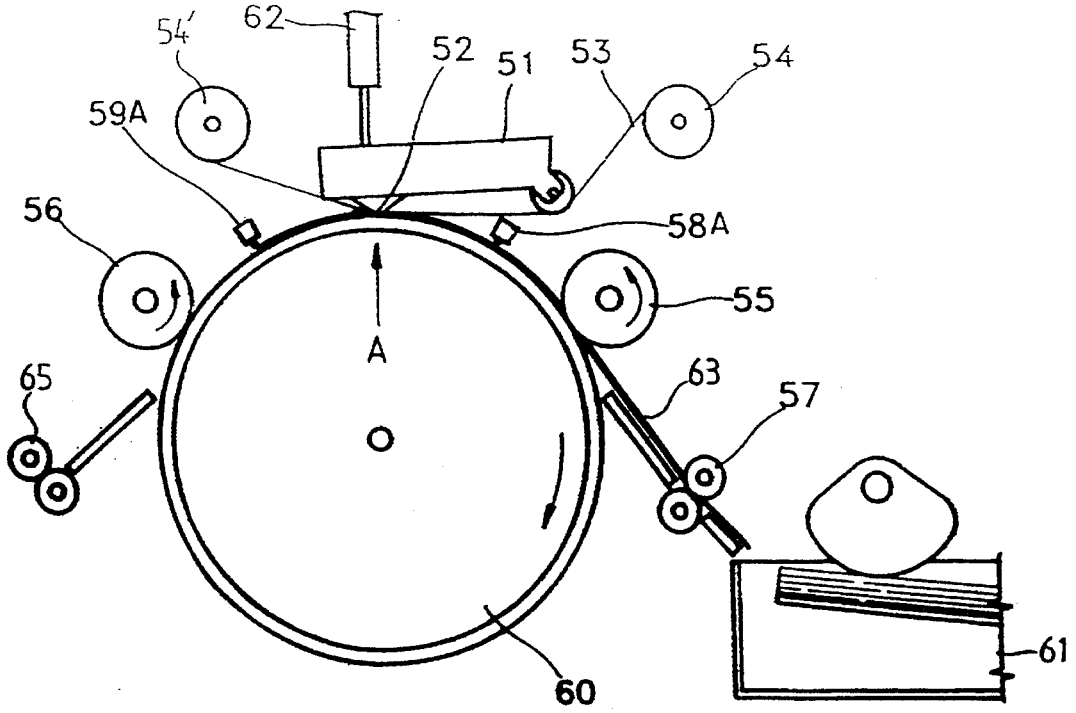

When the leading edge of the printing paper is sensed by second sensor 59A, the sensed result is fed to a drive source (not shown). The drum 60, receiving a driving signal from the drive source as shown in FIG. 11, is reversely rotated to reversely transfer the printing paper 63 to the initial printing position A. At this time, the control element 62 applies a first pressure to thermal print head 51 so as to bring the printing paper 63 close to the drum 60.

As shown in FIG. 12, the drum 60 again forwardly rotates and the thermal print head 51 receives a second pressure from control element 62 for printing, so as to print from the leading edge to the trailing edge of the printing paper 63, while applying pressure to the printing paper 63.

Figure 13:
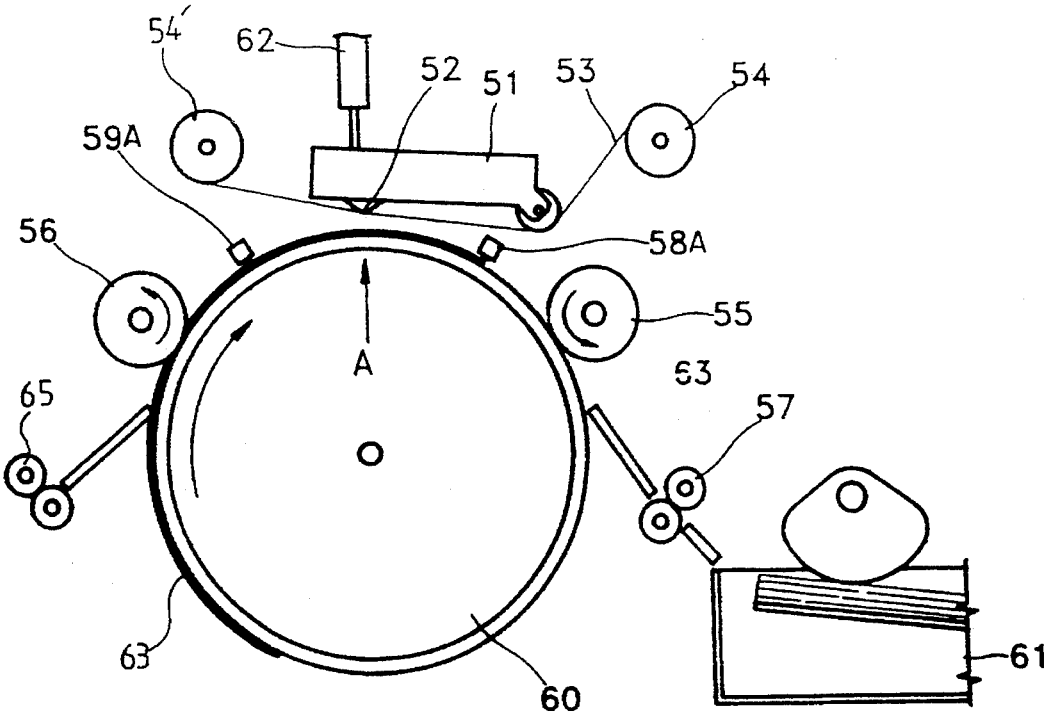

Thereafter, the thermal print head 51 is moved up by control element 62, and the drum 60 again reversely rotates. As shown in FIG. 13, the printing paper is transferred in the reverse direction, to a position slightly beyond the first sensor 58A.

Figure 14:
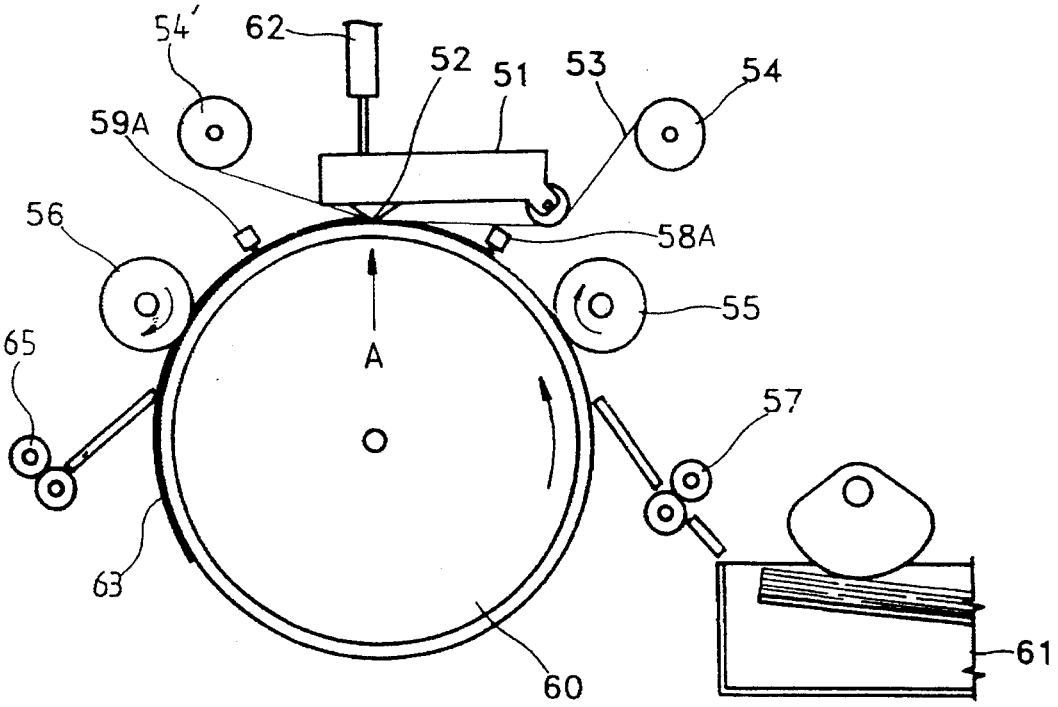

At this time, the thermal print head 51 moves down and receives the first pressure by the control element 62 as shown in FIG. 14, so as to bring the printing paper 63 close to the drum 60. While the printing paper 63 moves in the forward direction, the trailing edge of the printing paper 63 is sensed by the first sensor 58A, to be transferred to the initial printing position A in accordance with the sensed result.

Figure 15:
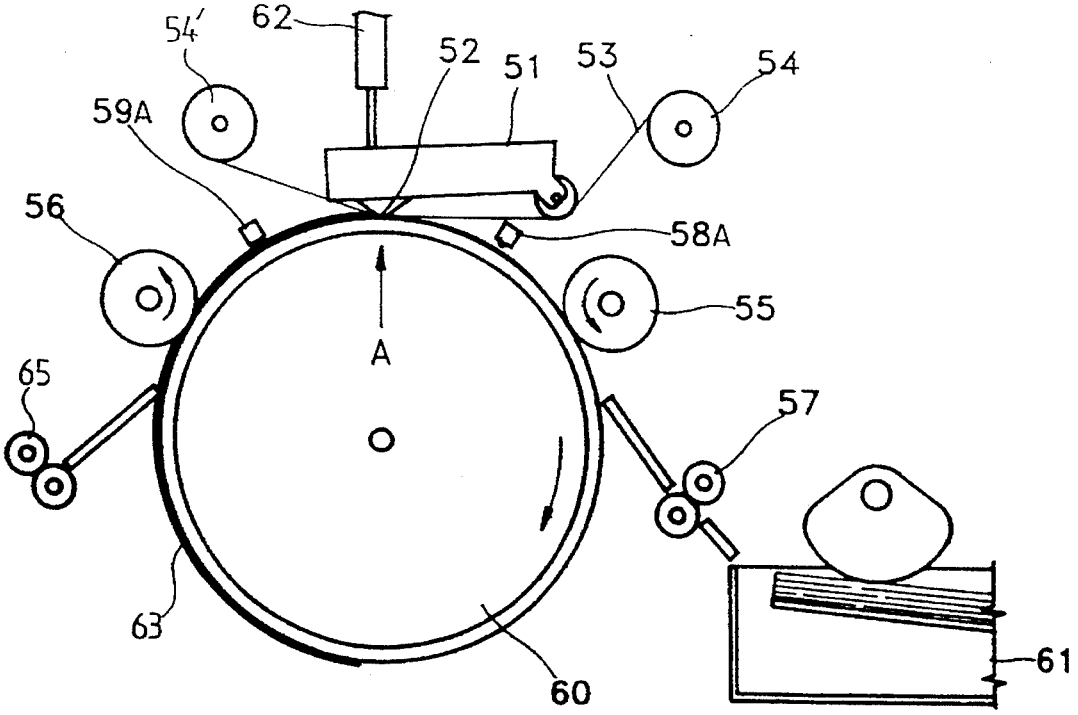

As shown in FIG. 15, the drum 60 reversely rotates and the control element 62 gives the second pressure to the thermal print head 51 to print from the trailing edge to the leading edge of the printing paper 63. Repeatedly performing the above steps, yellow, magenta and cyan color are all printed for the implementation of full color printing on the entire printing paper.

The third embodiment according to the printing method of the present invention will be explained, referring to FIGS. 9–12 and FIGS. 16–18.

The structure of the printer for performing the third embodiment is similar to that for printing according to the first and second embodiments, so that like elements are designated by the same reference numerals.

Considering the printing method according to the third embodiment, as shown in FIG. 9, the printing paper 63 which is supplied from the printing paper cassette 61 is guided by the paper supplying rollers 57, and the printing paper 63 is transferred between the drum 60 and the first roller 55 while in contact therewith, by the rotation force of the drum 60 and the friction force of the first roller 55. The printing paper 63 exiting the first roller 55 toward the initial printing position A, as shown in FIG. 10, passes over the initial printing position A, to a position slightly beyond the second sensor 59A.

The leading edge of the printing paper 63 is sensed by second sensor 59A. This sensed result is fed to a drive source (not shown). The drum 60, receiving a driving signal from the drive source as shown in FIG. 11, reversely rotates to reversely transfer the printing paper 63 to the initial printing position A. Here, the control element 62 applies the first pressure to thermal print head 51 so as to bring the printing paper 63 close to the drum 60.

Figure 12:
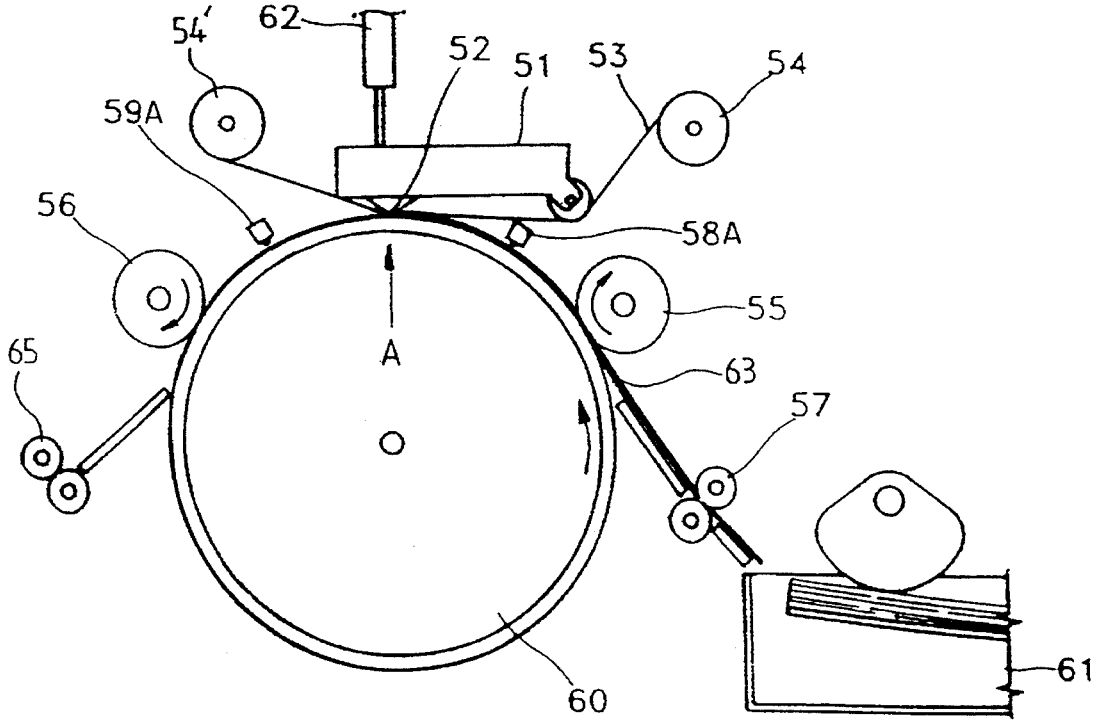

If the printing paper 63 is transferred to the initial printing position A, as shown in FIG. 12, drum 60 forwardly rotates and thermal print head 51 is given the second pressure from control element 62 in order to print, and thus prints from the leading edge to the trailing edge of the printing paper 63, under pressure applied to the printing paper 63.

Figure 16:
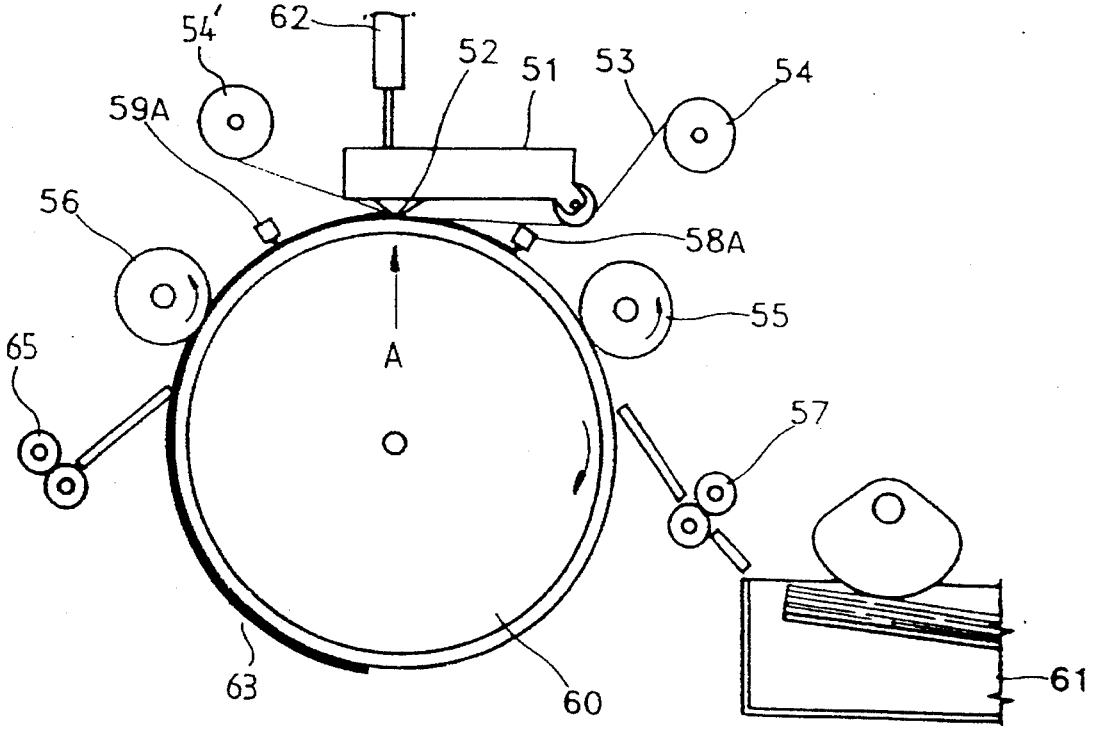
FIGS. 16, 17 and 18 are operative views for illustrating a thermal printing method according to still another embodiment of the present invention.

The printing paper 63 on which printing has been performed even in its trailing margin is, as shown in FIG. 16, reversely transferred by the reverse rotation of drum 60. At this time, thermal print head 51 comes to the first pressure state by control element 62.

Figure 17:
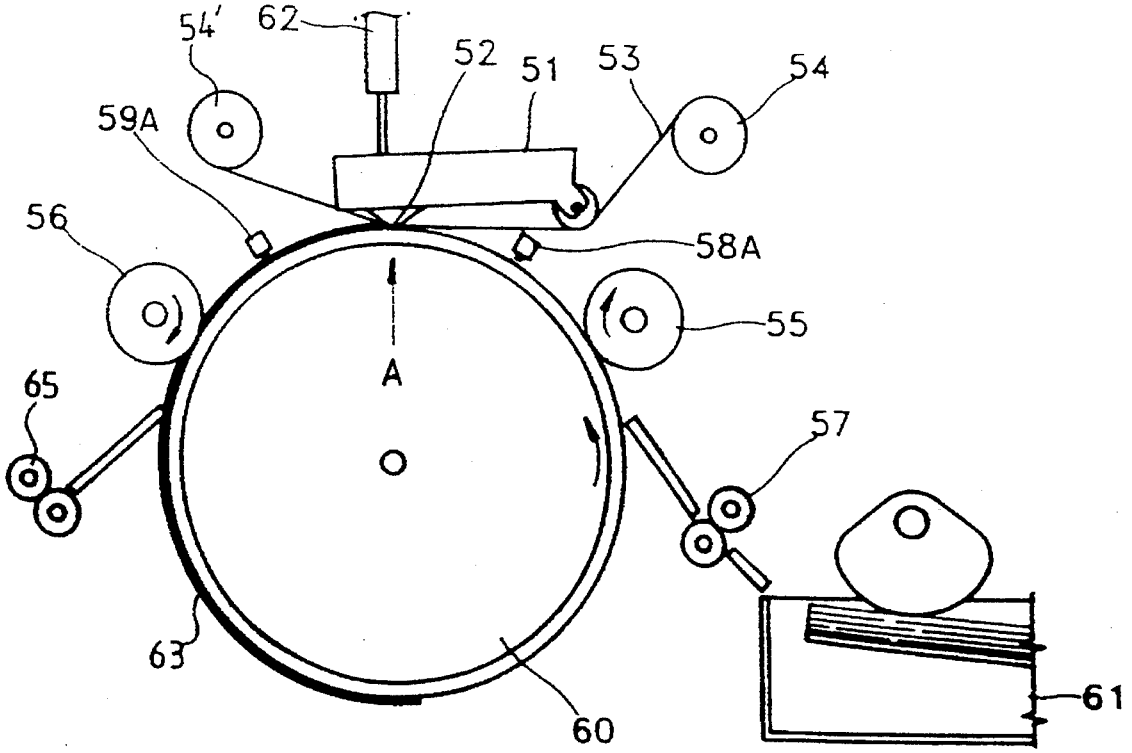

The trailing edge of the transferred printing paper 63 is sensed by first sensor 58A. While the drum 60, as shown in FIG. 17, forwardly rotates in accordance with the sensing result, the trailing edge of the printing paper 63 is transferred to the initial printing position A.

Figure 18:
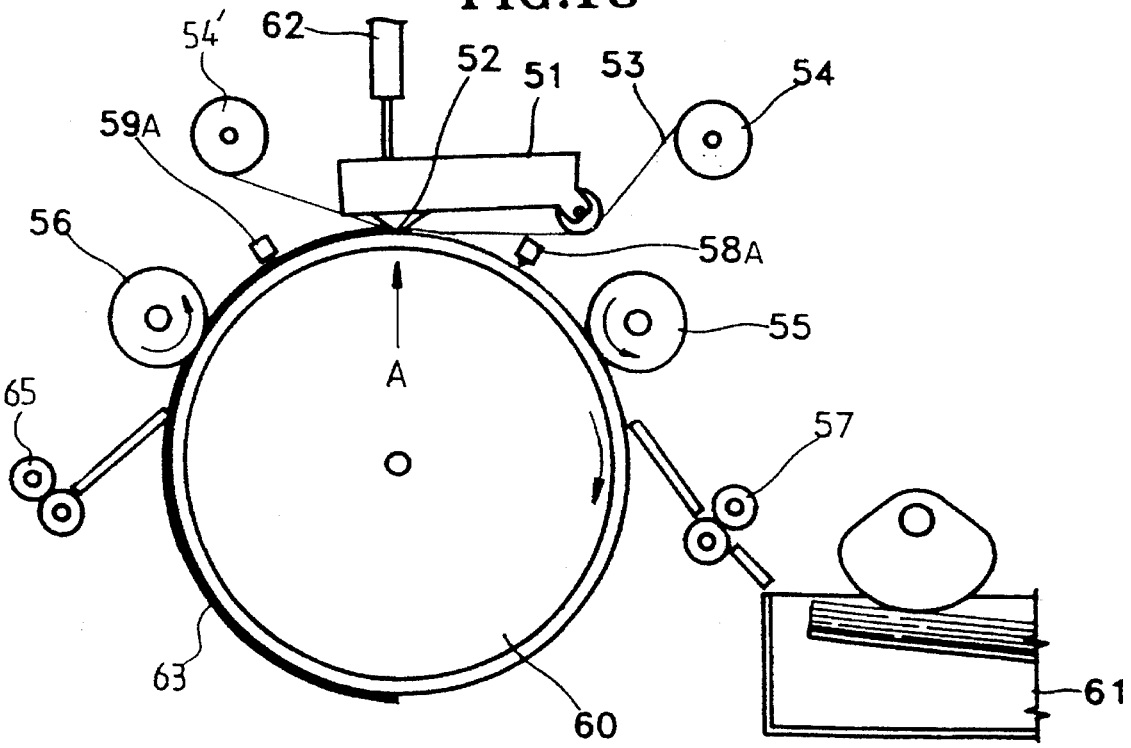

At this time, the drum 60, as shown in FIG. 18, reversely rotates and the control element 62 applies the second pressure to thermal print head 51 for printing, so that thermal print head 51 prints from the trailing edge to the leading edge of the printing paper 63. By repeatedly performing the above described steps, yellow, magenta and cyan are all printed, so as to print a full color image on the entire sheet of printing paper.

Though the printing method of the present invention has been explained, referring to the platen type printer, it can also be utilized by a drum type printer.

As described above, the present invention prints on the printing paper without any margins, so that the printed image is not compressed, the image at the margin is not truncated, paper is not wasted due to the generation of an unwanted margin, and a printed image having the shape of a photograph can be provided.

It is contemplated that numerous modifications may be made to the thermal printing method of the present invention without departing from the spirit and scope of the invention as defined in the following claims.

What is claimed is:

1. A thermal printing method, in which, while a printing paper is supplied to a rotating drum so as to be transferred, printing is performed by sublimating an ink film using heat generated by a thermal print head, said thermal printing method comprising the steps of:

first sensing a leading edge of said printing paper using at least one sensor which generates a signal indicating the presence of the transferred printing paper; and initially controlling said thermal print head in accordance with said signal indication, such that printing begins when the leading edge of said printing paper is transferred to an initial printing position, wherein in said first sensing step, said at least one sensor is placed at a position slightly before said initial printing position so as to sense the leading edge of said printing paper, said method further comprising a second sensing step for sensing a trailing edge of said printing paper by providing a second sensor for sensing the presence of said printing paper, at a position slightly beyond said initial printing position; and a second controlling step in which, when the trailing edge of said printing paper is sensed in said second sensing step, the trailing edge is reversely transferred to said initial printing position and said thermal print head is controlled such that printing is performed from the trailing edge of said printing paper to the leading edge thereof, wherein, after performing said second controlling step, said first sensing, initial controlling, second sensing and second controlling steps are repeatedly performed.

2. A thermal printing method, in which, while a printing paper is supplied to a rotating drum so as to be transferred, printing is performed by sublimating an ink film using heat generated by a thermal print head, said thermal printing method comprising the steps of:

first sensing a leading edge of the printing paper, by placing a first sensor which generates a sensing signal indicating the presence of said printing paper, at a position slightly beyond an initial printing position of said thermal print head;

moving said thermal print head down in accordance with said sensing signal, so that said thermal print head presses against the printing paper with a pressure; and initially driving said drum in order to position the leading edge of said printing paper back to the initial printing position while the thermal print head is down, and then driving said drum in order to print from the leading edge of said printing paper to a trailing edge thereof.

3. The thermal printing method according to claim 2, further comprising:

a second sensing step for reversely driving the drum to reversely transfer said printing paper and sensing the trailing edge of said printing paper, when printing is performed up to the trailing edge of said printing paper in the first printing step, by placing a second sensor which generates a signal indicating the presence of said printing paper, at a position slightly before the initial printing position; and a second driving step for, when the trailing edge of said printing paper is sensed in the second sensing step, reversely transferring the trailing edge of said printing paper to the initial printing position and driving the drum such that printing is performed from the trailing edge of said printing paper to the leading edge thereof, wherein, after the second driving step is performed, the first sensing step, the initial driving step, the second sensing step and the second driving step are repeatedly performed.

4. The thermal printing method according to claim 3, wherein the pressure of the thermal print head is controlled such that a pressure during reverse transferring of said printing paper until the trailing edge of said printing paper is sensed by the second sensor in the second sensing step and a pressure during reverse transfer of the trailing edge of said printing paper to the initial printing position in the second driving step is lower than a pressure during printing.

5. The thermal printing method according to claim 3, wherein said thermal print head is moved up during reverse transferring of said printing paper until said printing paper is sensed by the second sensor in the second sensing step, said thermal print head is moved down during reverse transferring of the trailing edge of said printing paper to the initial printing position in the second driving step, and the pressure of the thermal print head against the printing paper is controlled such that a pressure during reverse transferring of the trailing edge of said printing paper to the initial printing position is lower than a pressure during printing.

* * * * *